US011222499B2

(12) United States Patent
Mason

(10) Patent No.: US 11,222,499 B2
(45) Date of Patent: Jan. 11, 2022

(54) LIFTING BODY FOR A VENDING MACHINE DELIVERY BIN

(71) Applicant: Automated Merchandising Systems Inc., Kearneysville, WV (US)

(72) Inventor: Paul Mason, Inwood, WV (US)

(73) Assignee: Automated Merchandising Systems, Inc., Kearneysville, WV (US)

( * ) Notice: Subject to any disclaimer, the term of this patent is extended or adjusted under 35 U.S.C. 154(b) by 0 days.

(21) Appl. No.: 16/107,317

(22) Filed: Aug. 21, 2018

(65) Prior Publication Data

US 2020/0066083 A1 Feb. 27, 2020

(51) Int. Cl.
*G07F 9/10* (2006.01)
*G07F 11/00* (2006.01)

(52) U.S. Cl.
CPC ..... *G07F 9/10* (2013.01); *G07F 11/005* (2013.01)

(58) Field of Classification Search
CPC ..... G07F 9/10; G07F 11/005; G07F 11/14; G07F 11/16; G07F 11/18
See application file for complete search history.

(56) References Cited

U.S. PATENT DOCUMENTS 1,998,625 A * 4/1935 Kirk ..... G07F 11/16 312/35
4,296,872 A * 10/1981 Mitchell ..... G07F 11/42 221/195
4,352,603 A * 10/1982 Anders ..... B65G 51/30 406/112
5,454,332 A * 10/1995 Fennelly ..... G07F 19/20 109/19
5,570,783 A * 11/1996 Thorne ..... A61M 5/3205 206/366
5,909,823 A * 6/1999 Ranft ..... G07F 11/16 221/129
6,494,342 B1 * 12/2002 Wittern, III ..... G07F 11/10 221/192
8,123,071 B2 * 2/2012 Fitzgerald ..... B65G 1/04 221/124
8,162,174 B2 * 4/2012 Hieb ..... G07F 11/165 221/122
8,215,520 B2 * 7/2012 Miller ..... A47F 1/126 211/59.2
9,147,303 B2 * 9/2015 Loignon ..... G07F 11/24
9,330,519 B2 * 5/2016 Busto ..... G07F 11/165
9,652,923 B2 * 5/2017 Doom ..... G07F 11/16
9,870,671 B1 * 1/2018 Lad ..... G07F 11/38
10,251,503 B1 * 4/2019 Fulps ..... A47G 29/12
(Continued)

*Primary Examiner* — Gene O Crawford
*Assistant Examiner* — Kelvin L Randall, Jr.
(74) *Attorney, Agent, or Firm* — Davidson Berquist Jackson & Gowdey LLP

(57) ABSTRACT

An ADA compliant vending machine that raises vended product to a desired height, and specifically to a new and improved vended product delivery mechanism that moves between lowered and raised positions within a delivery bin within a vending machine, in a coordinated manner with the opening and closing of a delivery door, that raises the vended product for delivery to a customer at the desired height, and where front and rear delivery bin walls can be shaped to interlock with conforming shaped front and rear edges of the delivery mechanism to prevent vended product from becoming wedged or stuck there between.

17 Claims, 8 Drawing Sheets

(56) References Cited

U.S. PATENT DOCUMENTS

| | | | | |
|---|---|---|---|---|
| 2002/0145003 | A1* | 10/2002 | Nicolini | G07F 11/32 221/191 |
| 2003/0111478 | A1* | 6/2003 | Park | G07F 19/20 221/21 |
| 2009/0184130 | A1* | 7/2009 | Miller | A47F 1/126 221/279 |
| 2011/0017761 | A1* | 1/2011 | Roncari | G07F 11/42 221/1 |
| 2013/0020348 | A1* | 1/2013 | Loignon | G07F 11/24 221/277 |
| 2013/0320132 | A1* | 12/2013 | Granger | A47K 10/34 242/590 |
| 2015/0243120 | A1* | 8/2015 | Doom | G07F 9/023 221/1 |
| 2016/0240033 | A1* | 8/2016 | Tenney | G07F 11/60 |

* cited by examiner

LIFTING BODY FOR A VENDING MACHINE DELIVERY BIN

COPYRIGHT NOTICE

A portion of the disclosure of this patent document contains material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

FIELD OF THE DISCLOSURE

The present application relates generally to vending equipment and specifically to a new and improved vended product delivery mechanism, and, more specifically, to a simple and improved delivery bin within a vending machine that achieves compliance with the Americans with Disabilities Act (ADA).

INTRODUCTION

Vending machines offer unattended sales of commodities such as snacks, canned or bottled beverages, or any of a variety of other articles. The Revised ADA Regulations Implementing Title II and Title III issued by the Department of Justice in relation to the Americans with Disabilities Act and effective Mar. 15, 2011 (see 28 Code of Federal Regulations parts 35 and 36) alter the "side reach' range requirements to provide that the side reach range must now be no higher than 48" instead of 54" and no lower than 15" instead of 9". In addition, the force required to operate any mechanical mechanism must be less than 5 pounds (lbs). There is, therefore, a need in the art for an improved customer selection approach as well as an improved product dispensing mechanism for vending machines.

DESCRIPTION OF PRESENTLY PREFERRED EXAMPLES OF THE INVENTION

Brief Description of Figures

The invention is better understood by reading the following detailed description with reference to the accompanying drawings in which.

DESCRIPTION

A. Overview

Figure 1:
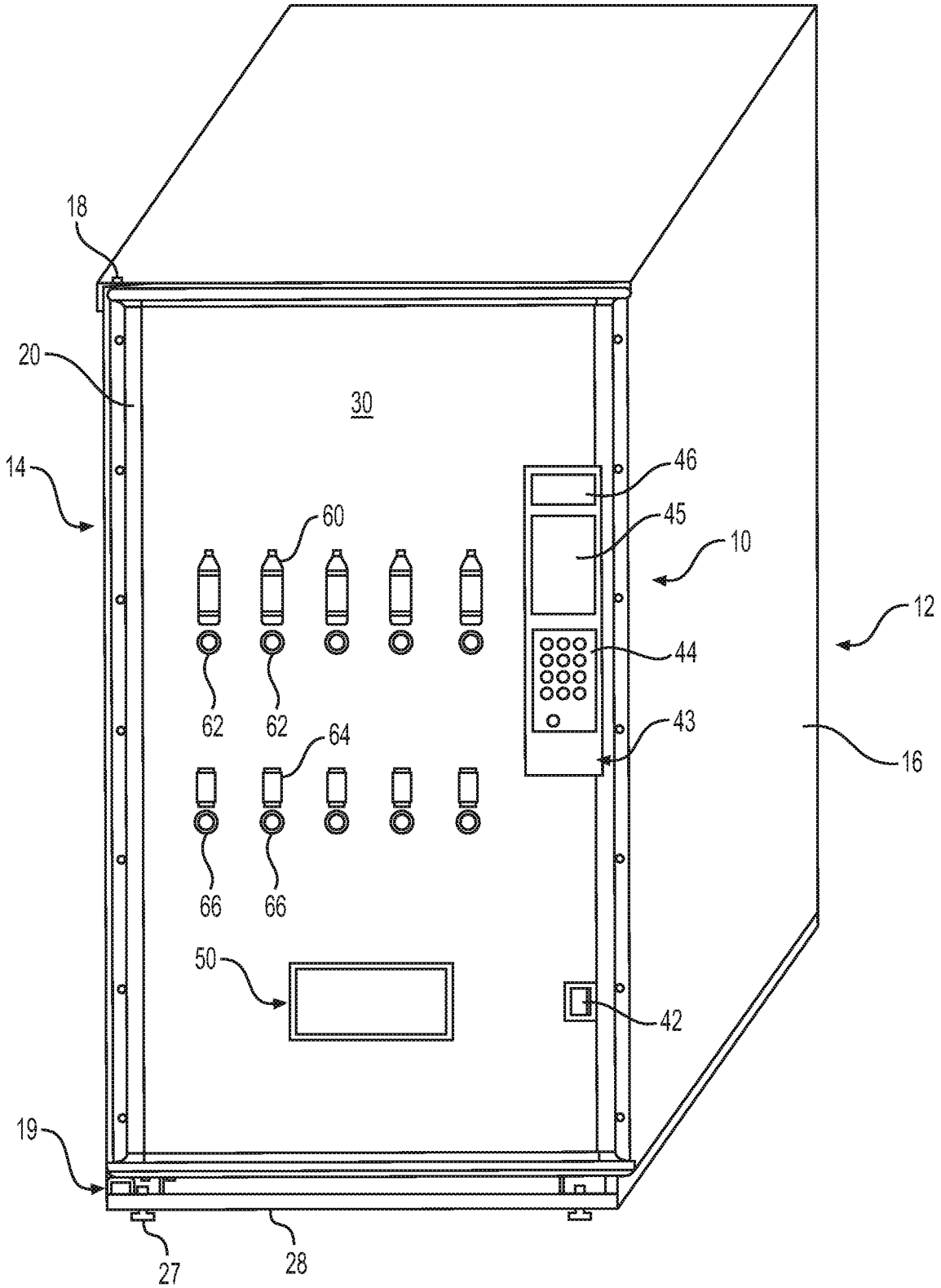
FIG. 1 is a front perspective of a closed front vending machine and the present invention.

To gain a better understanding of the invention, a preferred embodiment will now be described in detail. Frequent reference will be made to the drawings. Reference numerals or letters will be used throughout to indicate certain parts or locations in the drawings. The same reference numerals or letters will be used to indicate the same parts and locations throughout the drawings, unless otherwise indicated.

B. Environment

The preferred embodiment now described will be with respect to a vending machine so that the scale of the embodiment, therefore, is to be understood with respect to this type of article. It is to be understood as well, however, that the invention is applicable to other articles and its scale can vary accordingly.

C. Structure

An ADA compliant vending machine will have a user control for entering an ADA mode, and displays all user-actuated vend transaction controls below a first specified height when operating in the ADA mode. A delivery bin into which a vended products are received moves between a lowered position below a second specified height and a raised position above the first specified height in coordinate operation with the opening of the delivery bin door. Products are dropped below the second specified height during delivery, but are raised to or above that height for customer retrieval. The mechanical force required to open the delivery bin door is less than five pounds, even with closing of an anti-pilfer flap that occurs in a coordinated manner along with opening of the delivery bin door.

FIGS. 1 through 8, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged vending machine and an ADA compliant product delivery bin.

FIG. 1 front perspective view illustrating a vending machine implementing an ADA compliant customer product selection and payment mechanisms and a delivery bin according to a first embodiment of the present invention and shows a closed front vending machine 10 as being comprised of a case or cabinet 12 that includes a front service door 14 and a rear cabinet 16. The front service door 14 is pivotally mounted to the rear cabinet 16 by top and bottom hinges 18 and 19, respectively. Front service door 14 can include an inner door (not shown) that can be pivotally attached either to a portion of the front service door 14, or to the rear cabinet 16. Where the closed front vending machine is for frozen or cooled products, the front service door 14 and the rear cabinet will both be suitably insulated. The vending machine 10 can also include a suitable refrigeration unit (not shown) to maintain desired temperatures inside the machine. Height adjustment feet 27 supported by a bottom frame 28 are provided at each of the four bottom corners to provide adjustment capability for uneven floor surfaces.

The front service door 14 in FIG. 1 includes a front panel 30 that is retained in a frame 20 that extends around the sides, top and bottom of door 14. Door 14 also includes and supports a coin changer including a change return 42, a control panel 43, a suitable keypad 44, a display 46 that could be in the form of a touch-screen liquid crystal display (LCD) display and input, a customer payment mechanism in the form of a coin acceptor or bill validator 45, and a pivotally mounted retrieval door 50. Door 14 has sufficient internal space to mount other parts of the vending machine such as, for example, control electronics, the coin changer assembly, or other devices as may be desired. The front panel 30 can also include exemplary indicia of the contents of the vending machine, such as bottles 60, and bottle selection buttons 62 and/or exemplary cans 64 and can selection buttons 66.

The control panel 43 could also include a touch-screen liquid crystal display (LCD) display and input. The customer payment mechanism may include one or more of a coin slot allowing deposit of coins into a coin mechanism, a bill access slot for feeding paper currency into a bill validator and/or recycler, a magnetic stripe Swipe mechanism for reading the magnetic stripe on credit or debit cards, or a Radio Frequency Identification Device (RFID) sensor for sensing a customers RFID tag linked to a payment system.

Figure 2:
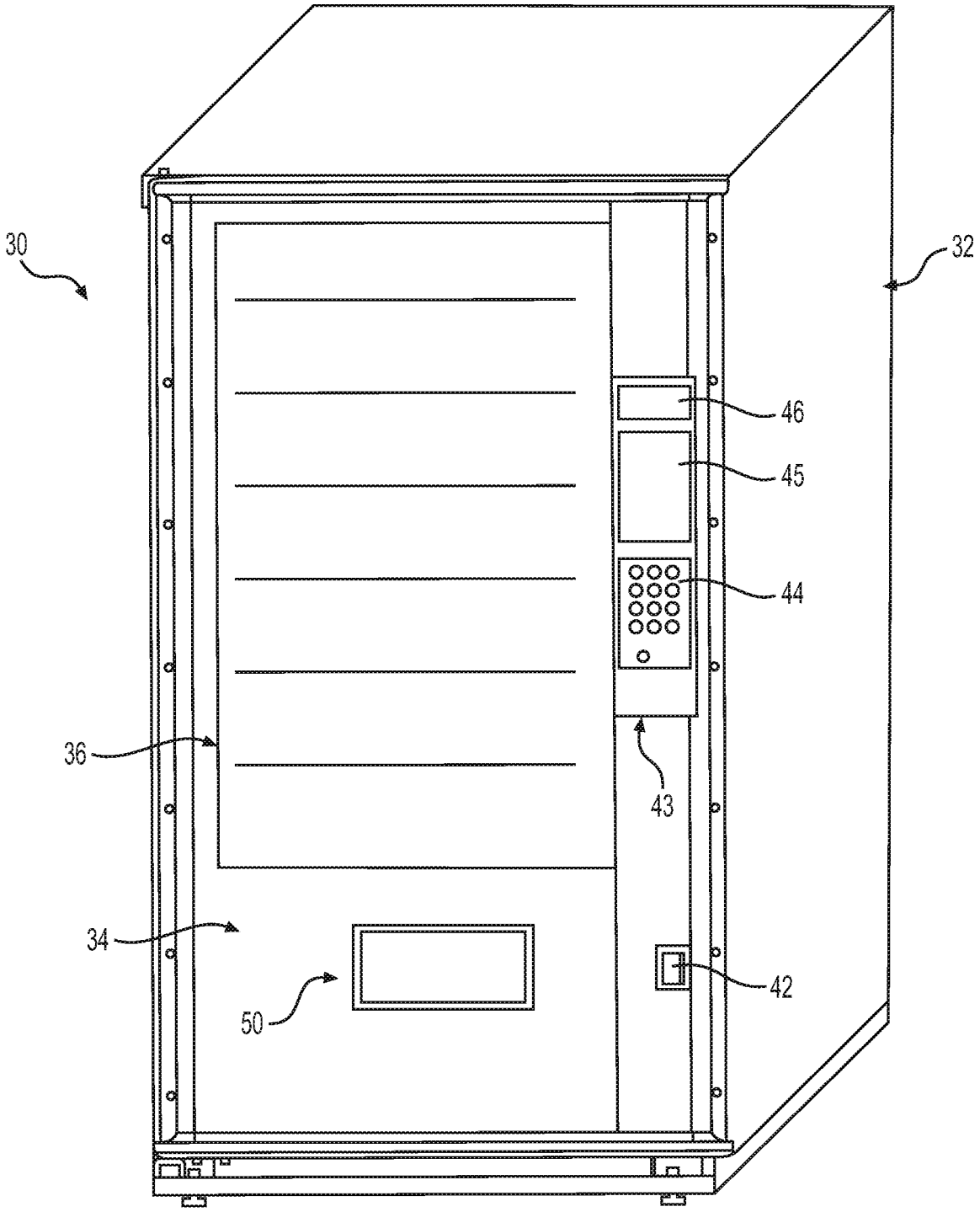
FIG. 2 is a front perspective of a transparent front vending machine and the present invention.

FIG. 2 is a front perspective view illustrating a vending machine implementing an ADA compliant customer product selection and payment panel and delivery bin according to another embodiment of the present invention. Vending machine 30 includes a cabinet 32 and a service door 34 that, together, define an enclosure. As in FIG. 1, the front service door 34 is pivotally mounted to the front of the cabinet 32 and extends all the way across the front face of the vending machine 30. In alternate designs, the service door may extend only part way across the front of the vending machine, or may be formed in two portions (of equal or unequal sizes) that when unlocked will swing open.

In FIG. 2, the service door 34 includes a transparent front glass or plastic portion 36 which allows the customer to view actual products available within the vending machine that are for vending. Such products may include various snack items, packaged beverages, various sundries, or any product capable of being dispensed by the vending machine. Vending machine 30 also includes a customer product selection, control and payment panel, as in FIG. 1, and a delivery bin access door 50, and selection and payment mechanisms as shown.

Figure 3:
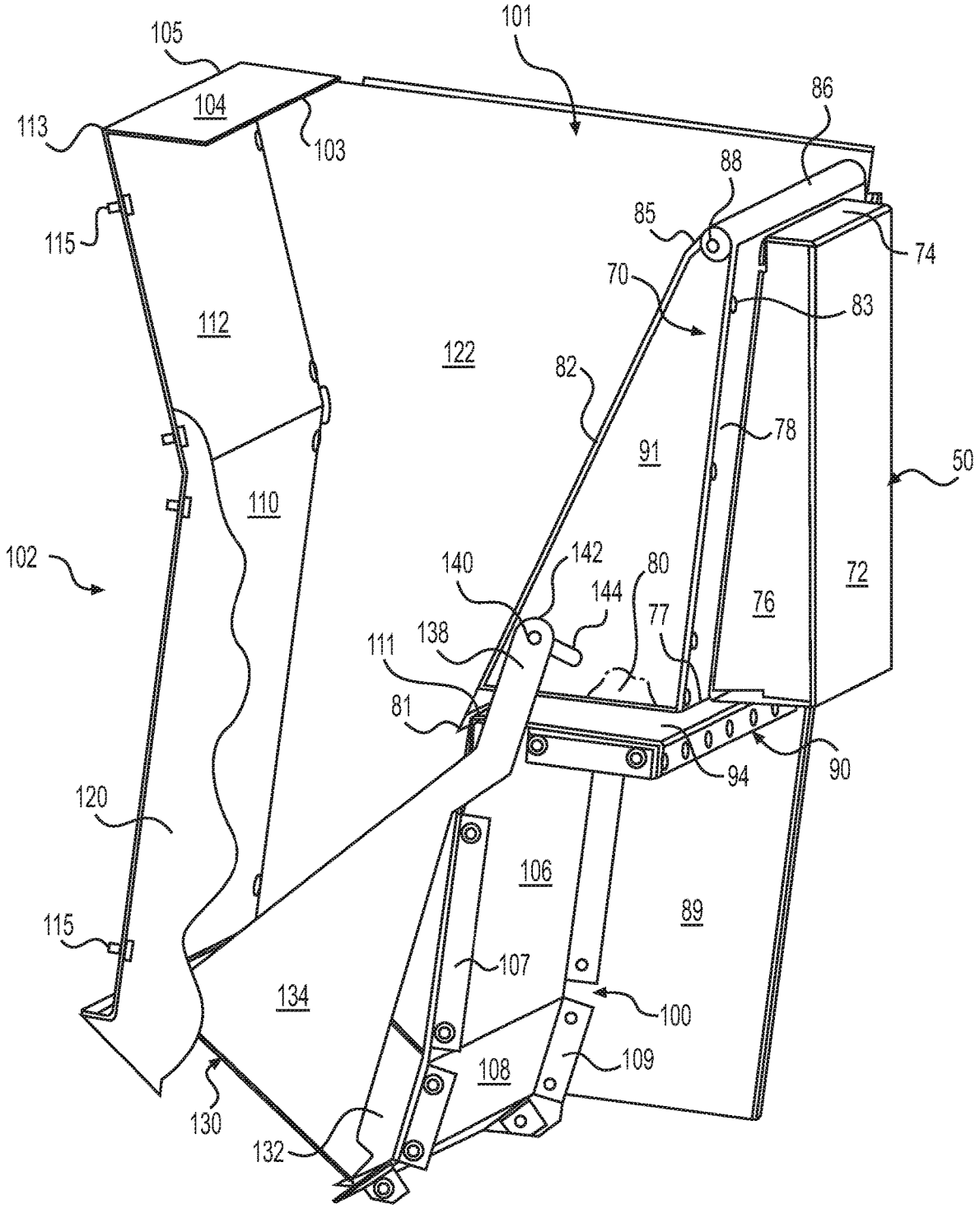
FIG. 3 shows a partially cut away perspective view of one embodiment of the lifting mechanism of the present invention in a home or lowered position.
Figure 4:
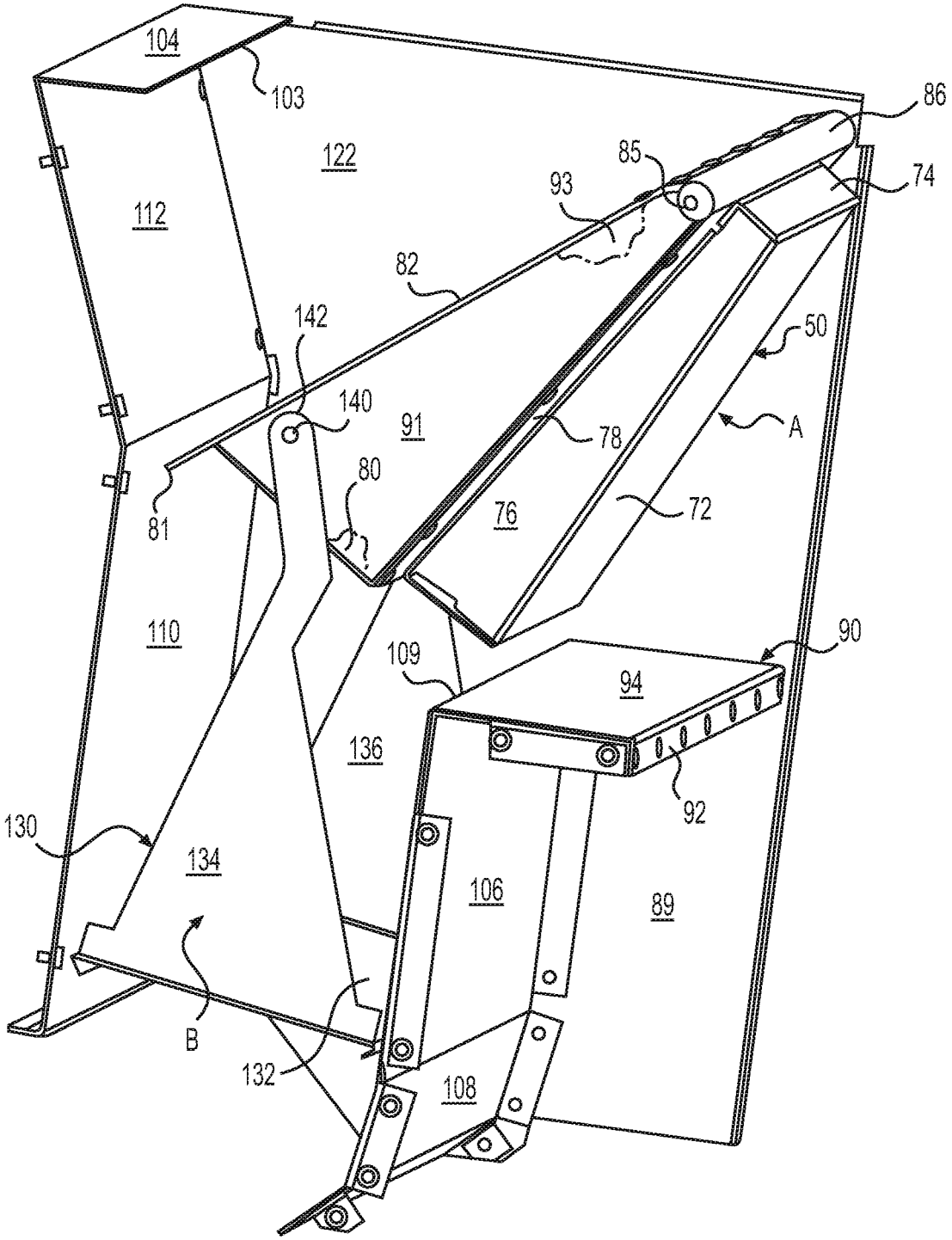
FIG. 4 shows a partially cut away perspective view of the embodiment of the lifting mechanism shown in FIG. 3 and in a partially raised position.
Figure 5:
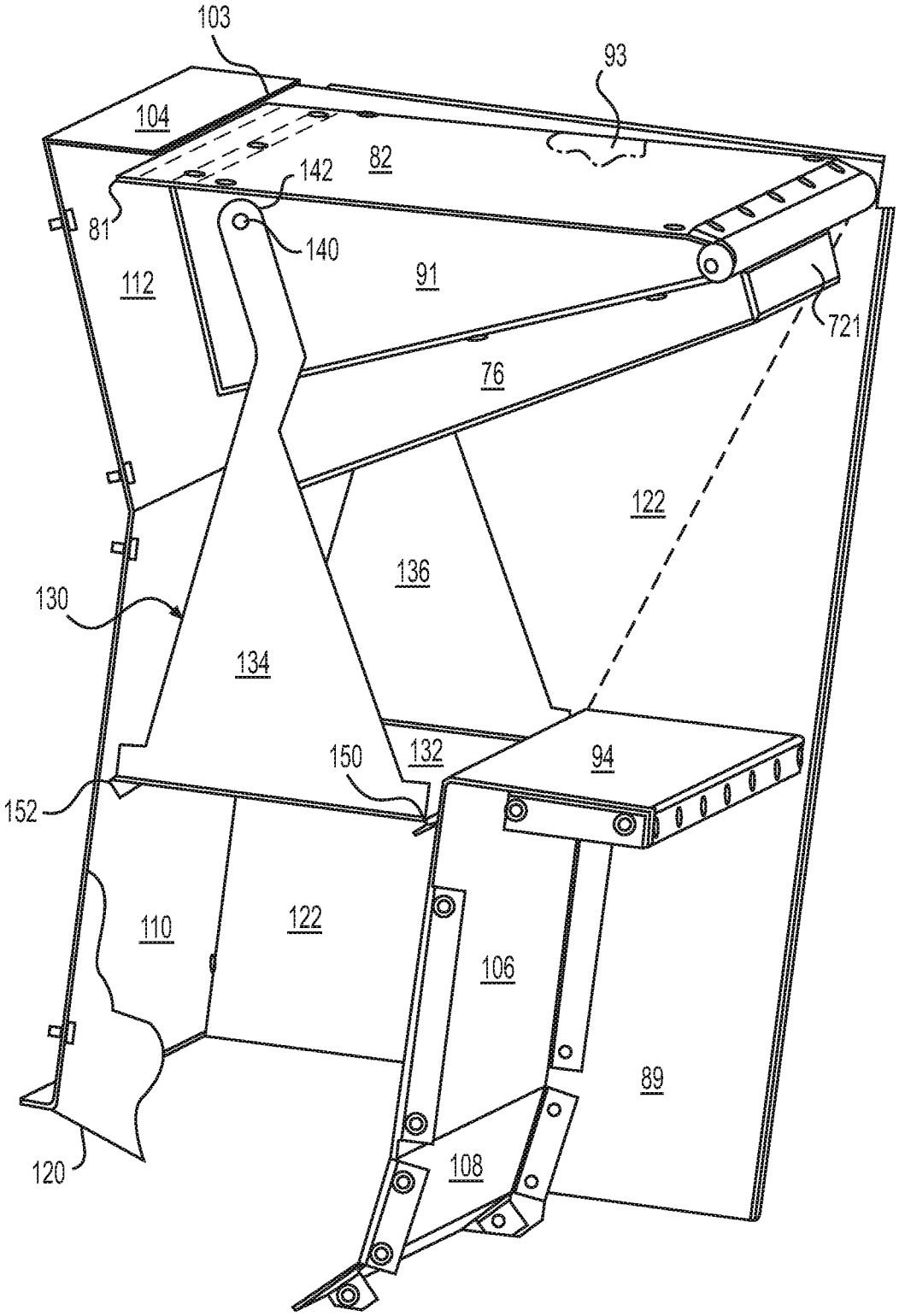
FIG. 5 shows a partially cut away perspective view of the embodiment of the lifting mechanism shown in FIG. 3 and in a fully raised position.

A first embodiment of the new, improved and positive vended product collection and lifting mechanism, for bringing vended product to the desired ADA vending height, is shown in FIGS. 3-5. The delivery bin access door 50 is shown as being supported on a frame generally indicated at 70. An exemplary delivery bin door 50 includes a front surface 72, a top 74 and side panels 76. It should be understood that a variety of door configurations could be used as well. The top 74 and side panels 76 can be operatively mounted to a planar front member 78 of frame 70. A bottom frame element 80 extends rearwardly from a bottom edge 77 of front member 78 and connects with a bottom portion spaced slightly above a bottom edge 81 of a planar rear member 82. The top edge 83 of front member 78 and the top edge 85 of the rear member 82 are connected to a cylindrical member 86 that has pivot pin connectors 88 at each end which are mounted to a suitable pivot connection in the vending machine frame, a portion of which is shown at 89.

The frame member 70 can be a hollow structure and includes side panels 91 and 93, on opposing sides of frame 70, which would span between the sides of the front and rear members, 78 and 82, respectively, and the bottom frame element 80.

A front ledge member 90, shown beneath the bottom of door 50, is supported by a frame 92 that is operatively connected to the vending machine frame, a portion of which is shown at 89, and includes a top planar surface 94.

The product delivery bin 101 includes a front bin wall, generally indicated at 100, a rear bin wall, generally indicated at 102, and a horizontally extending top plate 104 having a front edge 103. The front bin wall 100 can be a one-piece structure or it could be formed from several sections such as are shown at 106, an upper section, and a lower section or portion at 108. Each of the sections of the front bin member, or its various sections, can be mounted by frame members 107 and 109 to the vending machine frame a portion of which is shown at 89.

The rear bin wall 102 is preferably formed with a substantially vertical section 110 and an angled upper section 112 a top edge 113 being joined to the rear edge 105 of the top plate 104. The angle between the sections 110 and 112 can vary from about 135° to about 180°, and 160° is a preferred angle. The rear bin wall 102 can also be operatively connected to the vending machine frame by separate frame members, rivets, screws, adhesives or other suitable connection devices or devices, some of which are shown at 115. The delivery bin 101 also includes a pair of side walls, 120 and 122, that are operatively connected to side edges of the front and rear bin wall members 100 and 102, and to the top plate 104.

It should be understood that the front and rear bin wall members could be made from a single piece of sheet metal, suitably bent to form the sections 106/108 and 110/112, respectively. Further top plate 104 could also be part of a single piece of sheet metal and bent to the desired position relative to upper section 112. The front and rear bin members 100/102 could also be fabricated from plastic and molded in the desired shapes and sizes, from other metals or man made materials.

As shown in FIG. 3, when the bin door 50 is in its closed position the bottom edge 81 of the planar rear member 82 overlies a top edge 111 of section 106 adjacent the rear portion of ledge member 90 to thereby assure that a product falling into the bin will not hang up on a joint at that point.

A lifting body, generally indicated at 130, includes a bottom portion 132 and two side members 134 and 136. Each side member 134/136 includes an upper portion 138 that is necked down in size or is smaller than the lower portion of each side member 134/136 and includes an inwardly projecting pin 140 adjacent an upper end 142. Pin 140 moves within a slot 144 located in a lower rear portion of each side panel 91/93 of frame member 70.

The bottom portion 132 of the lifting body 130 forms the bottom of delivery bin 101 and it is on that member that a selected and vended product will come to rest.

FIG. 4 shows the delivery bin door 50 having been pivoted to partially open door 50 in the direction of arrow A, and the lifting body 130 has been moved upwardly within the deliver bin 101 in the direction of arrow B as pins 140 on each side are engaged by and moved within the slots 144 in each of the two opposing sidewalls 91 and 93. As door 50 becomes fully open, as is shown in FIG. 5, the lifting body 130 will be fully raised vertically and the bottom member thereof 132 will be at a level adjacent the top planar surface 94 of ledge member 90. This will place the selected product at the desired ADA height and permit a customer to easily retrieve that product from the bin 101.

At the same time, the rear surface 82 of the frame 70 will be moved into a nearly horizontal position with the bottom edge 81 lying against the horizontally extending top 104 and inboard of a front edge 103 of that top 104, which now acts as a stop member for the door 50. Since edge 81 lies inboard of front edge 103 the stopped position of surface 82 will act as an anti-pilfer flap preventing a customer or other individual from attempting to reach into the storage area of the vending machine.

The dimensions for the delivery bin and the lifting body can have a variety of sizes, depending upon the type of goods or products being vended. As an example, for one embodiment, the side-to-side width of the delivery bin 101 could be about 24 inches, the delivery bin could have a top-to-bottom depth of about 15 inches, and the bottom member 132 of the lifting body 130 could be about 24 inches long and have a front to back depth of about 4-6 inches. The front-to-rear depth of the bottom member 132 will be adjusted depending upon the distance between rear wall section 110 and front wall sections 106/108 so that the outer edges of the bottom member 132, specifically a front edge 150 and a rear edge 152, will be adjacent and close to the inside surfaces of the wall sections 110/108/106, respectively, to prevent any product, or portion of a product, to get stuck or trapped there between. Close to in this instance means about 0.03125 inches to about 0.125 inches. Also, the combined weight of the door 50 and frame 70 will be heavy enough to fully close door 50 following retrieval of a vended product.

Figure 6:
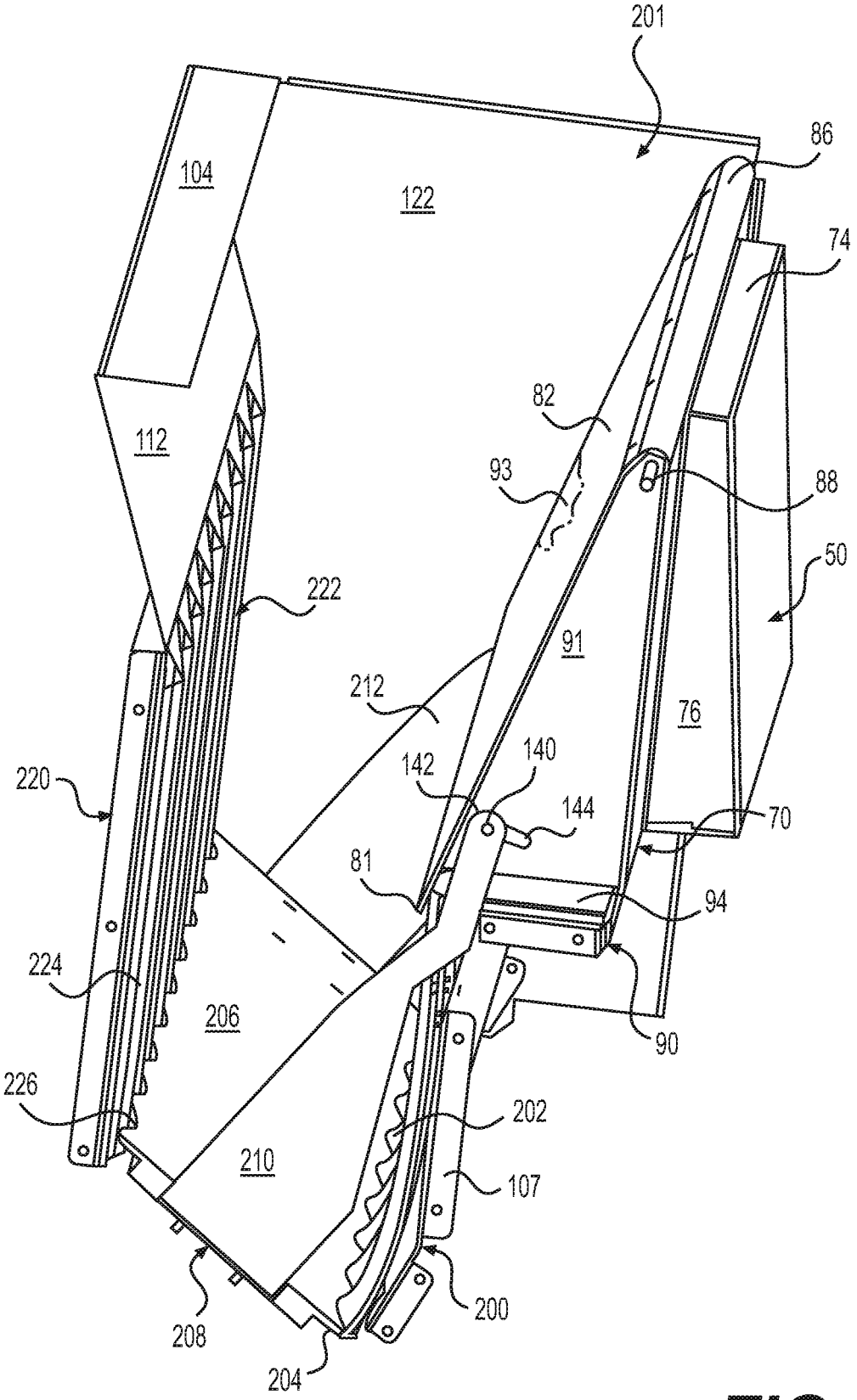
FIG. 6 shows a partially cut away perspective view of a second embodiment of the lifting mechanism of the present invention in a home or lowered position.
Figure 7:
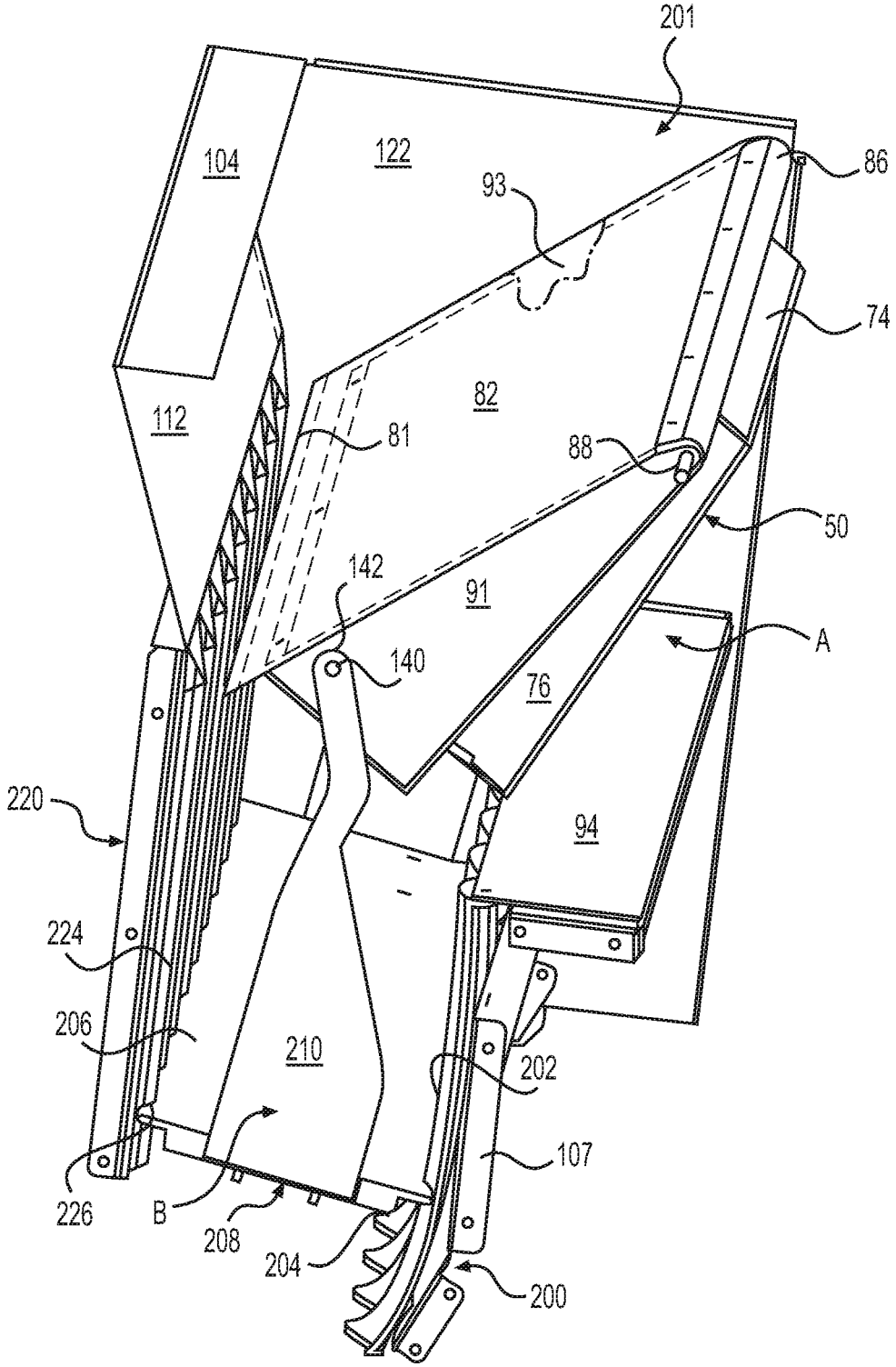
FIG. 7 shows a partially cut away perspective view of the embodiment of the lifting mechanism shown in FIG. 6 and in a partially raised position.
Figure 8:
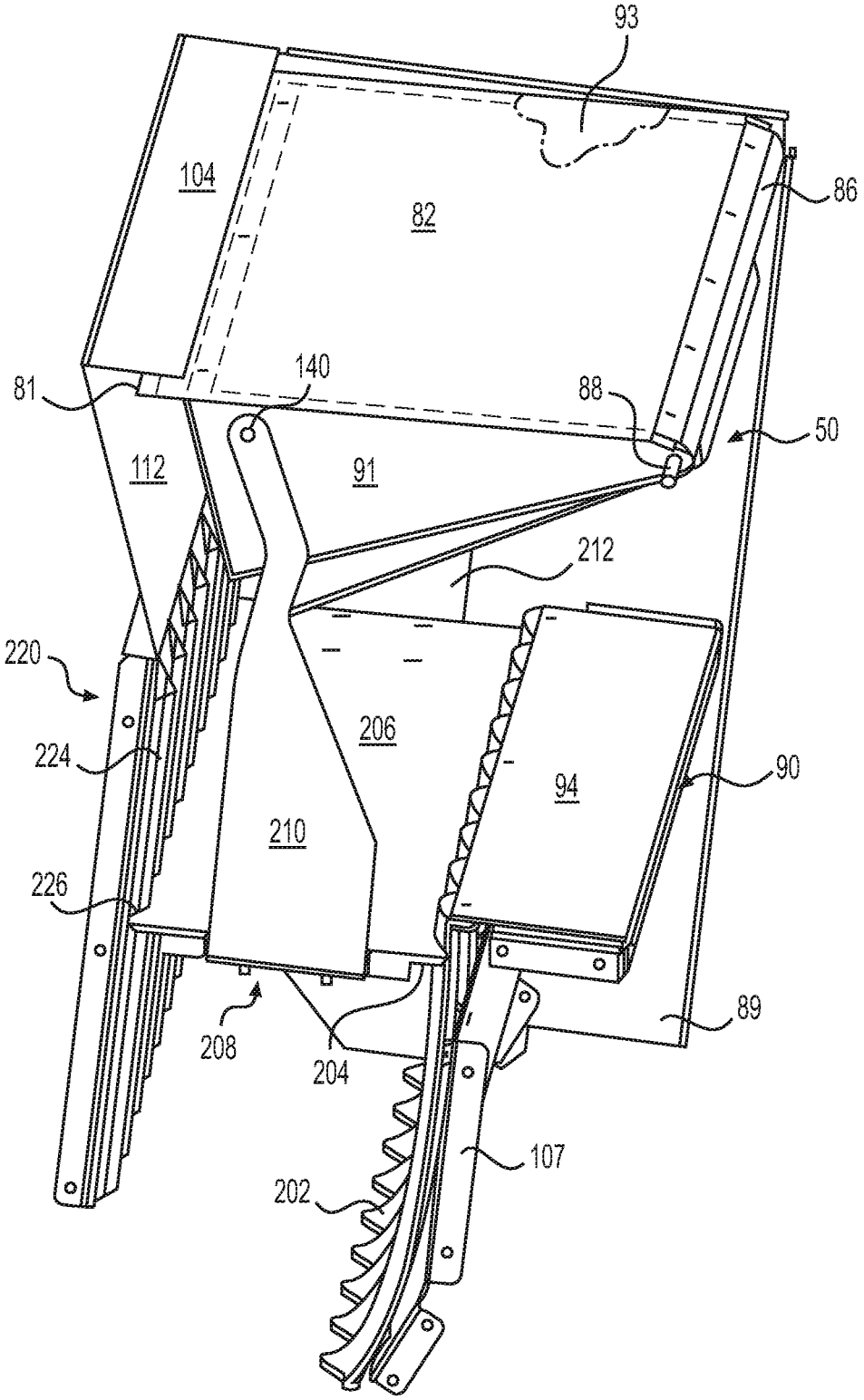
FIG. 8 shows a partially cut away perspective view of the embodiment of the lifting mechanism shown in FIG. 6 and in a fully raised position.

FIGS. 6-8 show a different embodiment in which the delivery bin has front and rear walls that have been shaped to correspond with, to interlock with, to be complimentary with, or to be meshing with, shaped front and rear edges of the bottom member of the lifting body. Specifically, the front wall 200 of the delivery bin 201 is provided with a preformed shaped inner surface 202 that will mate with, mesh against and/or intersect with a correspondingly shaped front edge 204 of a bottom member 206 of the lifting body 208 that also includes side members 210 and 212. Such shaped walls or the bin and the front/rear edges of the lifting body can include, for example, shapes that are square, triangular, V shapes, corrugations, half-rounds, and other shapes as well. The sizing of the corresponding shapes can also vary and shallow dimensions can be preferred over deeply recessed shapes. Pins 140 are once again used to mate with slots 144 in the sides 91/93 of the frame 70 in order to provide the lifting force to the lifting body 208 as door is pivoted into its fully open position as is shown in FIG. 8.

A modified rear wall 220 includes a interior surface 222 that is also shaped as at 224 to mate with, interlock with, mesh against, and/or intersect with a shaped rear edge 226 of bottom member 206. The shaped inner surface 224 is not provided on the inner side of wall section 112 as that wall section bends away from the bottom member 206, and as shown in FIG. 8 when fully lifted the bottom member 206 continues to remain engaged with the inner surface 222 and will not be raised to a height equal to wall section 112.

FIG. 7 shows the door 50 being partially opened in a direction indicated by arrow A, and the lifting body 208 being partially raised upwardly, as indicated by arrow B, within the confines of the delivery bin 201.

It can be noted that the shaped interior surfaces of walls 200 and 220 can be straight or vertical, or they can be curved should the travel of the bottom member 206 be moved along a curving path. The inner surface 224 is shown as being straight while the inner surface 202 is shown as having a concave curvature shape.

D. Operation

As should be clear form the foregoing, the improved product delivery mechanism is ADA compliant and is operated by a customer simply opening door 50 once a vend is confirmed as being complete to retrieve the vended product. By pushing door 50 in the direction of arrow A the product that has been vended will be resting on the bottom member 132/206 and will be moved upwardly and thus raised to a desired ADA height adjacent the ledge 90 and its top planar surface 94, and once the lifting body 130/208 has been fully raised as shown in FIGS. 5 and 8. When the product has bee retrieved further pushing of the door 50 will stop and door 50 return to its original position and the lifting body 130/208 will be returned to the bottom of the delivery bin 101/201.

E. Options and Alternatives

As was noted previously, the delivery bin and the lifting body can be formed from sheet metal, stamped bodies of metal or other materials or composites of materials, or formed as molded structures made of plastic or other man made materials and composites thereof.

When introducing elements of various aspects of the present invention or embodiments thereof, it may be advantageous to set forth definitions of certain words and phrases used throughout this patent document. The articles "a," "an," "the" and "said" are intended to mean that there are one or more of the elements, unless stated otherwise. The terms "comprising," "including" and "having," and their derivatives, are used to mean inclusion without limitation and are intended to be open-ended terms that specify the presence of the stated features, elements, components, groups, and/or steps, but do not exclude the presence of other unstated features, elements, components, groups, and/or steps and mean that there may be additional features, elements, components, groups, and/or steps other than those listed. The term "or" is inclusive, meaning and/or; the phrases "associated with and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, Such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances. Such definitions apply to prior, as well as future uses of such defined words and phrases.

Moreover, the use of "top" and "bottom," "front" and "rear," "above," and "below" and variations thereof and other terms of orientation are made for convenience, but does not require any particular orientation of the components. The terms of degree such as "substantially," "about"

and "approximate," and any derivatives, as used herein mean a reasonable amount of deviation of the modified term such that the end result is not significantly changed. For example, these terms can be construed as including a deviation of at least +/−5% of the modified term if this deviation would not negate the meaning of the word it modifies.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A vending machine having a vended product lifting retrieval mechanism provided therein, said vended product lifting retrieval mechanism comprising:

a frame assembly mounted internally within the vending machine forming at least a portion of a product retrieval bin, and having front and rear walls and an upwardly open upper portion;

a retrieval door pivotally mounted to the vending machine so as to move pivotally within the frame assembly between open and closed positions, and to provide an opening into the product retrieval bin when in the open position, said retrieval door having a front surface, singly opposing spaced apart sidewalls extending rearwardly from the front surface of the retrieval door, and a rear panel extending between the singly opposing spaced apart sidewalls, a lifting body movable within the product retrieval bin and for receiving a vended product, the lifting body comprising opposing, single, spaced apart side walls directly interconnected to a bottom member, wherein the opposing, single, spaced apart side walls and bottom member are positioned entirely within the product retrieval bin, the opposing, single, spaced apart sidewalls each having an a upper portion pivotally attached to the singly opposing spaced apart side walls of the retrieval door, the lifting body, including the interconnected bottom member and the opposing, single, spaced apart side walls, being movable between lowered and raised positions as the retrieval door is moved between said closed and open positions, with the raised position of the interconnected bottom member presenting the vended product at a desired raised height for product retrieval.

2. The vending machine as in claim 1 wherein said frame assembly provides a lifting motion guide for the lifting body.

3. The vending machine as in claim 1 wherein the rear panel comprises an anti-pilfering member when the delivery door is in said open position.

4. The vending machine as in claim 1 wherein each upper portion pivotal attachment includes a pin extending inwardly from each said upper portion into a slot provided in each of the singly, opposing, spaced apart sidewalls of said retrieval door.

5. The vending machine as in claim 1 wherein the bottom member of the lifting body includes front and rear edges that are shaped to interlock with a complimentary shaped portion of the front and rear walls of the delivery bin.

6. A method of delivering a vended product to a desired height comprising the steps of:

providing a delivery door assembly at a desired level suitable for all customers to retrieve vended products that can move between closed and open positions, the delivery door assembly including singly opposing spaced apart sidewalls extending rearwardly therefrom;

providing a vended product delivery lift so as to be movable within a substantial portion of an interior space of a delivery bin, the vended product delivery lift comprising a bottom member for receiving a vended product directly connected to and extending between a pair of single, vertically extending spaced apart, opposing side members, an upper portion of each of the single, vertically extending spaced apart opposing side members being operatively connected to the singly opposing spaced apart sidewalls of the delivery door assembly that are together movable between said open and closed positions;

causing the vended product delivery lift to be raised from a first lower position to a second higher position as the delivery door assembly is moved from said closed position to said open position, and causing an inside surface of the delivery door assembly to serve as an anti-pilfering shield when the delivery door assembly is in said open position.

7. The method of claim 6 wherein the bottom member is positioned to follow closely to inner front and rear walls of the delivery bin.

8. The method of claim 6 wherein the delivery bin has front and rear walls that are provided with a preformed shape there across, and the bottom portion has front and rear edges shaped to conform to and mesh with the preformed shape of the front and rear bin walls.

9. The method of claim 8 wherein the preformed shape of the front and rear walls comprises vertically extending undulations and the front and rear edges of the bottom member have a conforming shape.

10. The method of claim 9 wherein the undulations have a triangular cross sectional shape.

11. The method of claim 9 wherein the undulations have a square cross sectional shape.

12. The method of claim 6 wherein the delivery bin has front and rear walls that are provided with a preformed shape there across, and the bottom portion has front and rear edges shaped to interlock with the preformed shape of the front and rear bin walls.

13. A vending machine having a vended product retrieval mechanism provided therein comprising:

a frame assembly mounted internally within the vending machine forming at least a portion of a product retrieval bin, and having front and rear walls and an open upper portion;

a retrieval door movably mounted to the vending machine so as to move within the frame assembly between open and closed positions, and to provide an opening into a product retrieval bin when in the open position; singly, opposing spaced apart sidewalls extending rearwardly from said retrieval door, and a rear panel extending between the singly, opposing spaced apart sidewalls, a lifting body for receiving a vended product comprising opposing, single spaced apart side members and a bottom member being directly interconnected to a lower portion of each of the opposing, single spaced apart side members, an upper portion of each of the opposing, single spaced apart side members including a movable connection to the singly, opposing spaced apart sidewalls of the retrieval door, the lifting body being positioned so as to be movable within the interior of the product retrieval bin between lowered and raised positions as a function of the retrieval door movement between said closed and open positions, respectively, with the raised position of the lifting body presenting the bottom member and the vended product at a desired raised height for product retrieval.

14. The vending machine as in claim 1 wherein the rear wall of the product retrieval bin includes a stop member positioned at a top end thereof to intersect and stop movement of the rear panel.

15. A vending machine having a vended product lifting retrieval mechanism provided therein, said vended product lifting retrieval mechanism comprising:

a product retrieval bin assembly mounted internally within the vending machine;

a product retrieval door assembly mounted to the vending machine so as to move between open and closed positions;

said retrieval door assembly having singly opposing spaced apart sidewalls extending rearwardly from said retrieval door assembly, and a rear panel extending between said singly opposing spaced apart sidewalls that will comprise an anti-pilfering member when the delivery door assembly is in said open position, a lifting body movable within the product retrieval bin assembly, the lifting body having opposing, single, vertically extending spaced apart side members each having a bottom portion directly interconnected to a bottom member onto which a vended product will be received, the opposing, single, vertically extending spaced apart side members and the bottom member being positioned entirely within the product retrieval bin assembly, the opposing, single, vertically extending spaced apart side members each having an upper portion operatively attached to said singly, opposing spaced apart sidewalls of the retrieval door assembly, the lifting body being movable between lowered and raised positions as the retrieval door assembly is moved between said closed and open positions, with the raised position of the interconnected bottom member presenting the vended product at a desired raised height for product retrieval.

16. The vending machine as in claim 15 wherein the retrieval bin includes front and rear walls and the bottom member of the lifting body includes front and rear edges shaped to be complimentary to the front and rear walls of the retrieval bin.

17. The vending machine as in claim 15 wherein side, front and rear edges of said bottom member are positioned within the retrieval bin to follow closely complimentary interior surfaces of the retrieval bin as the lifting body moves between lowered and raised positions as the retrieval door is moved between its closed and open positions.

* * * * *